US006436475B1

(12) United States Patent
Adler et al.

(10) Patent No.: US 6,436,475 B1
(45) Date of Patent: Aug. 20, 2002

(54) PROCESS OF TREATING METALLIC SURFACES

(75) Inventors: Hans-Jürgen P. Adler, Pirna; Christian Bram, Lauf; Ralf Feser, Iserlohn; Evelin Jähne, Dresden; Christian Jung, Erlangen; Iris Mäge, Dresden; Jürgen Rudolph, Mörstandt; Lars Sebralla, Bruchköbel; Martin Stratmann, Neukirchen-Brand, all of (DE)

(73) Assignee: Chemetall GmbH, Frankfurt am Main (DE)

( * ) Notice: Subject to any disclaimer, the term of this patent is extended or adjusted under 35 U.S.C. 154(b) by 0 days.

(21) Appl. No.: 09/308,991

(22) PCT Filed: Dec. 18, 1997

(86) PCT No.: PCT/EP97/07100

§ 371 (c)(1),
(2), (4) Date: Dec. 17, 1999

(87) PCT Pub. No.: WO98/29580

PCT Pub. Date: Jul. 9, 1998

(30) Foreign Application Priority Data

Dec. 28, 1996 (DE) ..... 196 54 642

(51) Int. Cl.[7] ..... B05D 3/02; B05D 7/14

(52) U.S. Cl. ..... 427/358; 427/388.4; 427/409; 427/421; 427/435

(58) Field of Search ..... 427/384, 358, 427/409, 421, 435, 388.4

(56) References Cited

U.S. PATENT DOCUMENTS 3,634,146 A * 1/1972 Wystrach et al.
3,770,514 A * 11/1973 Wystrach
4,209,487 A * 6/1980 Hogue et al. ..... 422/12
5,059,258 A * 10/1991 Wefers et al. ..... 148/272
5,306,526 A * 4/1994 Gray et al. ..... 427/409

FOREIGN PATENT DOCUMENTS

| | | | |
|---|---|---|---|
| DE | 2614234 | * | 10/1977 |
| DE | 3137525 | * | 6/1982 |
| FI | 48855 | * | 9/1974 |
| SE | 4133102 | * | 4/1993 |

OTHER PUBLICATIONS

Horner et al, Werkst. Korros. 29(10), pp. 654–664, 1978.*
Translation of Horner, Werkst. Korros. 29(10), pp. 654–664, 1978.*

* cited by examiner

*Primary Examiner*—Erma Cameron
(74) *Attorney, Agent, or Firm*—Fulbright & Jaworski L.L.P.

(57) ABSTRACT

The invention relates to a method for treating metallic surfaces consisting of zinc, magnesium or aluminium or of the alloys of zinc, magnesium or aluminium, to which lacquer, coatings of plastic material, paint, sealants or adhesives are applied after treatment. The treatment of the metallic surfaces takes place at between 10° C. and 100° C. by immersion, spraying or rolling with an aqueous solution. The solution has a pH of between 2 and 13 and contains one or more compounds of the type XYZ at a concentration of between $10^{-5}$ and 1 mol/l. Y is an organic group containing between 2 and 50 C atoms and has a straight-chain structure. X is a COOH, $HSO_3$, $HSO_4$, $(OH)_2PO$, $(OH)_2PO_2$, (OH)(OR')PO or $(OH)(OR')PO_2$ group. Z is a OH, SH, $NH_2$, NHR', CN, $CH{=}CH_2$, OCN, epoxy, $CH_2{=}CR''{-}COO$, acrylamide, COOH, $(OH)_2PO$, $(OH)_2PO_2$, (OH)(OR')PO or $(OH)(OR')PO_2$ group. R' is an alkyl group with between 1 and 4 C atoms. R" is an H atom or an alkyl group with between 1 and 4 C atoms. Groups X. and Z are each bonded to group Y in their final positions.

21 Claims, 1 Drawing Sheet

PROCESS OF TREATING METALLIC SURFACES

Figure 1:
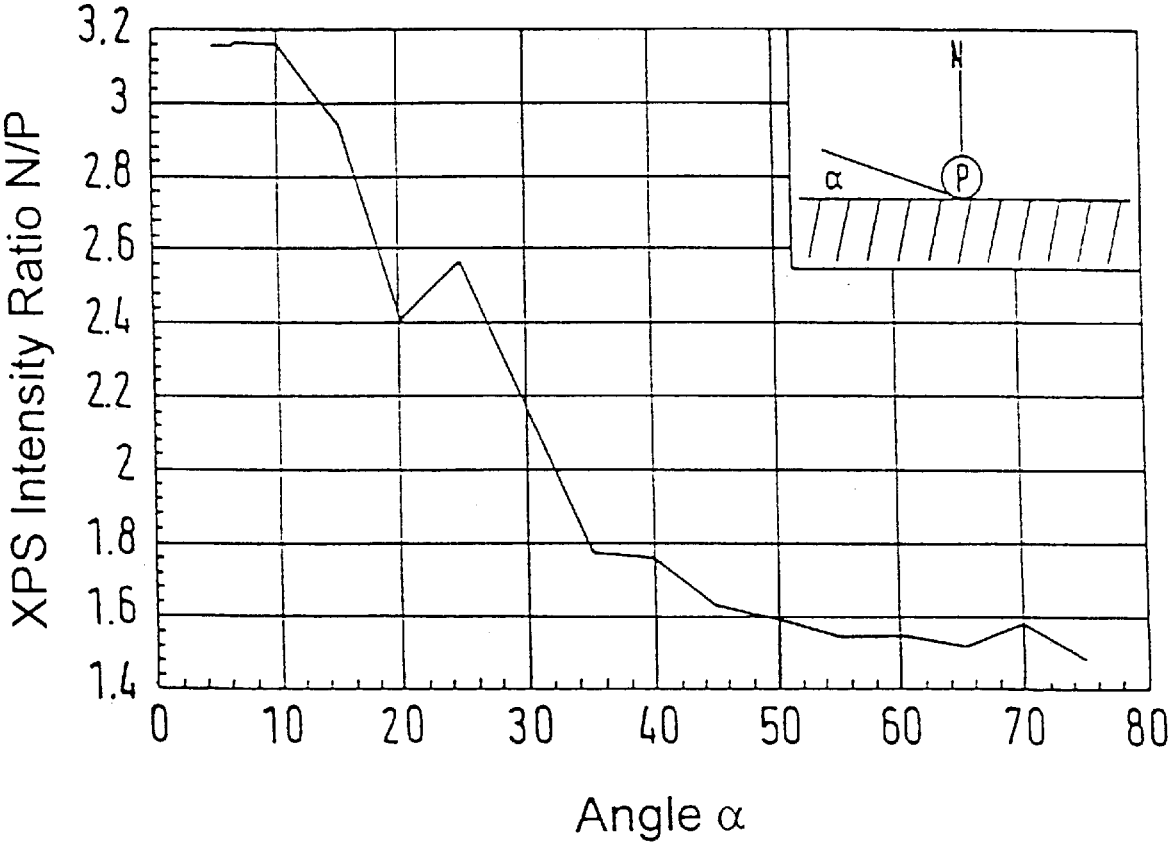

This invention relates to a process of treating metallic surfaces which consist of zinc, magnesium or aluminium, or of the alloys of zinc, magnesium or aluminium, and to which lacquers, plastic coatings, paints, sealing compounds or adhesives are applied after the treatment.

It is known that the corrosion of polymer-coated metallic surfaces is due to electrochemical reactions at the metal/polymer phase boundary. In many coating techniques applied in the art, the metal surfaces are therefore coated with an inorganic conversion layer (e.g. zinc phosphate) before applying a lacquer or plastic coating. Due to the conversion treatment by means of a coat-forming phosphatizing or chromatizing process, the metallic surface is prepared for subsequently being coated with a lacquer or a plastic.

Even today, the conversion treatment of aluminium surfaces is effected by means of yellow chromatizing, where an acid chromate solution with a pH value of 1 to 2 is used, so that a protective layer is formed on the aluminium. The protective layer consists of an insoluble aluminium-chromium(III) mixed oxide and effects the high passivity of the surface against corrosion. The residual content of unused chromate ions left in the oxide layer in addition produces a self-healing effect in a damaged lacquer or plastic coating. However, the yellow chromatizing aluminium surfaces has the disadvantage that it only has insufficient adhesion-promoting properties with respect to a lacquer or plastic coating. Moreover, chromate ions are disadvantageously washed out of naturally weathered coatings.

As an alternative to chromatizing a process was developed which employs zirconium salts, fluorides, phosphates and organic polymers (e.g. polyacrylates and polyvinyl alcohols). By means of this process, coatings are formed on aluminium surfaces which provide the substrate with a certain protection against corrosion and a fairly good adhesion for lacquer and plastic coatings. However, the achieved protection against corrosion is not always satisfactory.

Moreover there was no lack of attempts at optimally fitting metallic surfaces of zinc, magnesium, aluminium and the alloys thereof for the application of lacquer and plastic coatings by treating such surfaces with organic substances.

From DE-A-3137525 there is known a process of inhibiting corrosion in an aqueous system, where the aqueous system contains at least one inorganic nitrite soluble in water, and at least one organic diphosphonic acid or at least one salt of diphosphonic acid. The diphosphonic acid is present in the aqueous system in a concentration of 0.1 to 20 ppm. The known aqueous system is used to avoid in particular corrosion problems in cooling systems. In the aqueous system, the hydroxyethylidene diphosphonic acid and the inorganic salts thereof are particularly preferred.

From EP-A-0 012 909 it is known that benzimidazolyl-2-alkane-phosphonic acids and the salts thereof have a pronounced corrosion-inhibiting effect and can be used as corrosion inhibitors. For inhibiting corrosion, they can be used singly, in combination with each other, or together with other known corrosion inhibitors. For inhibiting corrosion, the compounds are generally added to aqueous, aqueous-alcoholic, alcoholic and/or oil-containing media. They may for instance be used as corrosion inhibitors in heat-transfer media of cooling or heating circuits, in coolants, mineral oils or pickling inhibitors. By adding the compounds and/or the salts thereof to said media or circulating liquids the corrosion of metals, in particular of copper and its alloys, is prevented. The benzimidazolyl-2-alkane phosphonic acids contain a phosphonic acid group, a straight-chain or branched, saturated or unsaturated, bivalent, possibly substituted hydrocarbon residue with 1 to 15 carbon atoms, and a substituted benzimidazole residue, where the straight-chain or branched hydrocarbon residue and the benzimidazole residue are connected with each other via position 2 of the benzimidazole residue.

From U.S. Pat. No. 4,351,675 there is known an aqueous solution for the treatment of zinc, zinc alloys or cadmium, which contains nitric acid, an oxidizing agent ($H_2O_2$, nitrate, nitrite, chlorate) and a diphosphonic acid, where the two phosphonic acid groups are connected with each other via a carbon atom which in addition has a hydroxyl group and an alkyl residue with 1 to 4 carbon atoms.

From U.S. Pat. No. 5,059,258 there is finally known a process, where on an aluminium substrate with a pH value of 2 to 14 there is first of all produced a layer of aluminium hydroxide, and where then a further layer is deposited on the aluminium hydroxide layer by treatment with an organic phosphinic acid or an organic phosphonic acid. The organic residue of the phosphinic or phosphonic acid each contains 1 to 10 organic groups and 1 to 30 carbon atoms. The molecule of the organic phosphinic and phosphonic acids contains 1 to 10 phosphinic and phosphonic acid groups. For producing the hydroxide layer there is used an aqueous solution containing amines, amino alcohols, alkali hydroxides, alkaline earth hydroxides, alkali carbonates, alkali hydrogen carbonates or ammonia. For producing the second layer there is used a solution in which the phosphinic and phosphonic acids are present in a concentration of 0.001 mol/l up to the saturation concentration, and which as solvent contains water, an alcohol or an organic solvent. As organic groups, the phosphinic and phosphonic acids contain for instance aliphatic hydrocarbons, aromatic hydrocarbons, organic acids, aldehydes, ketones, amines, amides, thioamides, imides, lactams, anilines, piperidines, pyridines, carbohydrates, esters, lactones, ethers, alkenes, alcohols, nitrites, oximes, silicones, ureas, thioureas, perfluorated organic groups, silanes, and combinations of these groups. The second layer should act on the substrate in particular as a good adhesion promoter for lacquer and plastic coatings as well as for paints.

It is the object underlying the invention to create a process of treating metallic surfaces which consist of zinc, magnesium or aluminium, or of the alloys of zinc, magnesium or aluminium, in order to provide the metallic surfaces in particular with a good adhesion for lacquers, plastic coatings, paints, sealing compounds and adhesives, and to protect the metallic surfaces against corrosion.

The object underlying the invention is solved in that the metallic surfaces are treated at 10 to 100° C. by dipping, spraying or rolling with an aqueous solution which has a pH value of 2 to 13 and contains $10^{-5}$ to 1 mol/l of one or more compounds of the type XYZ, where Y is an organic group with 2 to 50 carbon atoms and a straight-chain structure, where X is a COOH—, $HSO_3$—, $HSO_4$—, $(OH)_2PO$—, $(OH)_2PO_2$—, (OH)(OR')PO— or (OH)(OR')$PO_2$— group, where Z is an OH—, SH—, $NH_2$—, NHR'—, CN—, $CH{=}CH_2$—, OCN—, epoxide—, $CH_2{=}CR''$—COO—, acrylamide—, COOH—, $(OH)_2PO$—, $(OH)_2PO_2$—, (OH)(OR')PO— or (OH)(OR')$PO_2$— group, where R' is an alkyl group with 1 to 4 carbon atoms, where R" is a hydrogen atom or an alkyl group with 1 to 4 carbon atoms, and where the groups X and Z are each bound to the group Y in their terminal position.

The effect of the inventive process is based on the ability of the Compounds XYZ to organize spontaneously and to form very thin, closed films on metallic surfaces, where there is in particular effected an orientation of the acid groups in the direction of the metallic surface, and between the metal hydroxide groups present on the metallic surface and the acid groups of the compound XYZ a chemical bond is formed. In accordance with the invention, the structure of the compounds XYZ was chosen such that there is obtained a reactive coupling of the thin film both to the metal surface and to the matrix of lacquers, plastic coatings, paints, sealing compounds and adhesives. The straight-chain organic group Y acts as "spacer" between the groups X and Z; it more or less provides the compound XYZ with the properties of a surfactant, as the organic group Y has hydrophobic properties. The group Z provides the coated surface with a good wettability and reactivity with respect to lacquers, plastic coatings, paints, sealing compounds and adhesives. When lacquers, plastic coatings, paints, sealing compounds and adhesives are applied onto the thin films, the advantageous properties of the thin films are maintained even under the influence of corrosive media, so that the metallic surfaces are protected against corrosion. The reactive group Z should particularly be adjusted to the individual lacquers.

In accordance with a further aspect of the invention it is provided that in the aqueous solution 0.1 to 50% of the water are replaced by an alcohol with 1 to 4 carbon atoms, by acetone, by dioxan, or by tetrahydrofuran. These organic solvents effect a higher solubility of the compounds XYZ, which in general are larger molecules whose solubility in pure water is not very high. On the other hand, the solution always contains a large amount of water, so that even with the presence of organic solvents the system may still be called an aqueous system.

In accordance with the invention it is particularly advantageous when the aqueous solution contains one or more compounds of the type XYZ in a concentration which lies in the range of the critical micellization concentration. The critical micellization concentration cmc is a concentration characteristic for the respective surfactant, where the surfactant molecules start to aggregate to micelles. The aggregation is reversible. Below the cmc, i.e. when the solutions are diluted, the micelles break down again to form monomeric surfactant molecules. The numerical value of the cmc depends on the constitution of each surfactant and on external parameters such as ionic strength, temperature and concentration of additives. As methods for determining the cmc there may for instance be used measurements of the surface tension. By means of the ring or plate method, the surface tension $\delta$ of a surfactant solution is determined in dependence on its concentration c at a constant temperature. The cmc is recognized as salient point in the plot $\delta$=f (lg c). Examples for determining the cmc of various surfactants can be found in "Die Tenside", edited by v. Kosswig and Stache, Carl Hanser Verlag, München, Wien, 1993.

In accordance with the invention it turned out to be particularly useful when the aqueous solution contains a defoaming agent and/or a solubilizer, each in an amount of 0.05 to 5 wt-%. The defoaming agent facilitates the handling of the inventive solution, which due to the surfactant properties of the compounds XYZ tends to foaming. The solubilizer advantageously limits the use of organic solvents and promotes the use of pure water. Both as defoaming agent and as solubilizer there may for instance be used amino alcohols.

In accordance with the invention it turned out to be useful in some cases when the compounds of the type XYZ are present as salts in the aqueous solution. In general, the salts have a better solubility than the compounds themselves, and the dissolved salts are also very stable, so that the handling of the inventive solution is improved by using the salts of the compounds XYZ. In practice, in particular the sodium and potassium salts are used.

In accordance with the invention, Y is an unbranched, straight-chain alkyl group with 2 to 20 carbon atoms, or an unbranched, straight-chain group which consists of 1 to 4 aromatic $C_6H_4$ nuclei connected in the para-position, or a group which consists of one or two unbranched, straight-chain alkyl residues each with 1 to 12 carbon atoms, and of 1 to 4 aromatic $C_6H_4$ nuclei connected in the para-position. All inventive groups Y are thus characterized by a straight-chain, unbranched molecular structure, which is optimally suited to act as "spacer" between the groups X and Z. In accordance with the invention, the groups Y can thus have the following structure:

a) X—$(CH_2)_m$–Z; m=2 to 20 b) X—$(C_6H_4)_n$–Z; n=1 to 4 c) X—$(CH_2)_o$–$(C_6H_4)_p$–$CH_2)_q$; o=0 to 12, p=1 to 4, q=0 to 12, o or q unequal to 0.

In accordance with the invention it is particularly advantageous when Y is an unbranched, straight-chain alkyl group with 10 to 12 carbon atoms or a p–$CH_2$—$C_6H_4$—$CH_2$—group or a p,p'—$C_6H_4$—$C_6H_4$—group. These groups Y provide the inventive compounds XYZ with very good adhesion-promoting properties for lacquers and other organic coatings. Furthermore, it is particularly advantageous when X is an $(OH_2)PO_2$—or (OH)(OR')$PO_2$—group, and when Z is an $(OH_2)PO_2$—, (OH)(OR')$PO_2$—, OH—, SH—, NHR'—, CH=$CH_2$—or $CH_2$=CR'—COO—group. Compounds of the type XYZ, which are equipped with the aforementioned groups X and Z, likewise have good adhesion-promoting properties for lacquers and plastic coatings, and in addition form a solid chemical bond with the metallic surfaces.

Aqueous solutions which contain the below-mentioned compounds of the type XYZ have very good adhesion-promoting and corrosion-inhibiting properties:

1-phosphonic acid-12-mercaptododecane, 1-phosphonic acid-12-(N-ethylamino)dodecane, 1-phosphonic acid-12-dodecene, p-xylylene diphosphonic acid, 1,10-decane diphosphonic acid, 1,12-dodecane diphosphonic acid, 1-phosphoric acid-12-hydroxydodecane, 1-phosphoric acid-12-(N-ethylamino)dodecane, 1-phosphoric acid-12-mercaptododecane, 1,10-decane diphosphoric acid, 1,12-dodecane diphosphoric acid, p,p'-biphenyl diphosphoric acid, 1-phosphoric acid-12-acryloyldodecane. These compounds form a bond with the metallic surfaces via the phosphonic and phosphoric acid groups, and by means of their aliphatic or aromatic group and their functional group Z act as adhesion promoter with respect to the various organic components of the lacquers, the plastic coatings, the paints, the sealing compounds and the adhesives.

In accordance with a further aspect of the invention it is provided that the aqueous solution is applied to the metallic surfaces at 10 to 100° C. by means of the dipping, spraying or rolling known per se, where the dipping time is 5 seconds to 20 minutes, the spraying time is 5 seconds to 15 minutes, and the rolling time is 2 to 120 seconds. It was observed that a thin film is formed on the metallic surfaces when the aqueous solution is applied by dipping, spraying or rolling, where rinsing the treated metallic surfaces is not absolutely necessary, but may be advantageous.

In accordance with the invention it is provided that the metallic surfaces are subjected to an alkaline and/or acid pickling before applying the aqueous solution, and are subsequently rinsed with water. The used water may be deionized or not deionized. The metallic surfaces consisting of zinc, magnesium, aluminium and the alloys thereof are always covered by oxidic layers and in addition contaminated by the superficial adsorption of carbon dioxide, water and/or hydrocarbons. These contaminated covering layers are not able to permanently bind lacquers, plastic coatings, paints, sealing compounds and adhesives and ensure a long-term protection against corrosion. In accordance with the invention, the metallic surfaces are therefore cleaned before treating them with the aqueous solution.

In accordance with a further aspect of the invention it is provided that the metallic surfaces, to which the aqueous solution was applied by dipping or spraying, are subsequently rinsed with water and possibly dried in a nitrogen or air stream, where the temperature of the nitrogen or air stream is 15 to 150° C. Rinsing and drying does not impede the formation of the thin film on the metallic surfaces. The water used for rinsing may be deionized or not deionized.

It is particularly advantageous when the inventive process is used for the treatment of metallic surfaces to which there is subsequently applied a cathodic or anodic electrodeposition paint, a powder coating, a coil-coating paint, a high-solids paint or a paint diluted with water. In all painting processes, the pretreatment of the metallic surfaces with the aqueous solution in accordance with the invention was particularly useful.

The subject-matter of the invention will subsequently be explained in detail with reference to several examples:

EXAMPLE 1

Processes Sheets Consisting of the Alloy AlMg1 are used as Substrates.

a) Dipping

First of all, the sheets are dipped into an alkaline pickling solution for 3 minutes at room temperature, which pickling solution contains 32 g/l NaOH and 8 g/l $Na_2CO_3$. Subsequently, the sheets are rinsed with deionized water. Then, the sheets subjected to alkaline pickling are dipped into an acid pickling solution for 3 minutes at 40° C., which pickling solution contains 10 g/l $H_2SO_4$ and 33 g/l $H_2O_2$. Subsequently, the sheets are rinsed with deionized water. Finally, the pickled sheets are dipped into the inventive aqueous solution for 3 minutes at 40° C., which solution contains the inventive compound XYZ in a concentration of about $10^{-3}$ mol/l. Subsequently, the sheets are rinsed with deionized water and dried at room temperature in a nitrogen stream.

b) Spraying

The sheets are first of all sprayed with an alkaline pickling solution for 10 seconds at 65° C., which pickling solution contains 10 g/l Bonder V338M®. Subsequently, the sheets are rinsed by spraying them with water. Then, the sheets subjected to alkaline pickling are sprayed with an acid pickling solution for 30 seconds at 50° C., which pickling solution contains 16 g/l Bonder V450M®. Subsequently, the pickled sheets are rinsed by spraying them with deionized water. Finally, the sheets are sprayed with the inventive aqueous solution for 30 seconds at 40° C. The sheets are subsequently rinsed with deionized water and dried in an air stream at room temperature. The inventive compound XYZ is present in the aqueous solution in a concentration of about $10^{-3}$ mol/l. (® registered trademark of the Metallgesellschaft AG, Frankfurt/Main, Germany)

c) Roll coating

The sheets are first of all subjected to alkaline and acid pickling corresponding to the spraying process, and rinsed. Subsequently, the inventive aqueous solution is roll-coated onto the sheets for two seconds at room temperature, where the roller is operated with 25 revolutions per minute. In the inventive aqueous solution the compound XYZ is present in a concentration of about $10^{-3}$ mol/l. Upon roll coating the aqueous solution, the sheets are dried in a circulating air oven at 105° C.

d) Compounds of the Type XYZ

For performing the process variants aqueous solutions were used, for instance, which contained the following compounds XYZ:

1-phosphonic acid-12-(N-ethylamino)dodecane 1-phosphoric acid-12-hydroxydodecane p-xylylene diphosphonic acid 1,12-dodecane diphosphonic acid e)Painting The sheets treated with the inventive aqueous solution were painted according to various processes. There was used both a cathodic electrodeposition paint and a powder coating and a polyester paint. The electrodeposition paint was electrolytically (cathodically) deposited on the sheets at a voltage of about 250 V and subsequently dried for 22 minutes at 180° C. The powder coating was applied to the sheets by electrostatic spraying and subsequently dried for 10 minutes at 200° C. The polyester paint system consisted of a primer and a top coat. Both components were applied to the sheets by means of doctor blades. Upon stoving, the primer had a layer thickness of 5 $\mu$m, whereas the top coat had a layer thickness of 25 $\mu$m. The stoving temperatures were 216° C. for the primer and 241° C. for the top coat.

EXAMPLE 2

Test Results

The subsequent table includes the test results obtained when using different substances in accordance with the invention. The substances were contained in the inventive solutions in a concentration of about $10^{-3}$ mol/l. The salt spray test ESS reinforced by means of acetic acid reveals that the thin films produced in accordance with the invention provide a very good protection against subsurface corrosion as against the comparative sheets; of the comparative sheets only the chromatized sheet is sufficiently protected against corrosion. The T-bend test, which was carried out under the $T_0$ condition, as well as the cross-cut adhesion test with Erichsen cupping reveal that the paint adhesion on the sheets treated in accordance with the invention is better than on the comparative sheets. On the whole, the results achieved by means of the invention are surprisingly good, as in terms of corrosion resistance they are equivalent and in terms of paint adhesion they are clearly superior to the results achieved by means of chromatizing.

By means of an angle-dependent X-ray photoelectron spectroscopy (ARXPS) the orientation of the molecules of the compounds of the type XYZ was determined. Due to the very limited escape depth of the characteristic photoelectrons, the angle-resolved X-ray photoelectron spectroscopy provides for a varying information depth of the spectral data in dependence on the angle $\alpha$. In the case of small angles, the information depth lies in the range up to about 1 nm, and in the case of larger angles it lies in the range up to about 10 nm. This provides for determining the orientation of the molecules. This method is described for instance in the publication by Briggs, Practical Surface Analysis, 1990, Wiley & Sons, Chichester. FIG. 1 shows the X-ray photoelectron spectrum of the 1-phosphoric acid-12-(N-ethylamino)dodecane on the alloy AlMg1, in which the XPS intensity ratio N/P is represented in dependence on the angle $\alpha$, where N is the intensity of the N1s peak of the amino group, and P is the P2s peak of the phosphoric acid group, and where the abbreviation XPS stands for the term X-ray photoelectron spectroscopy. The spectrum proves that the phosphoric acid group bonds to the metal surface, and the amino group is facing away from the metal surface.

TABLE

| Compound | T-bend test (TO) Area chipped off according to LPV 75 [%] | ESS test according to DIN 50021 ESS subsurface corrosion [mm] | Cross cut test with Erichsen cupping according to ISO 1520 | Filiform test according to DIN 65472 [mm] |
|---|---|---|---|---|
| ADPS | 1 | <1 | 0 | — |
| AUDS | 10 | 1 | 0 | — |
| HDLS | 10 | 1 | 0 | — |
| XDPS | 20 | <1 | — | <1 |
| HDPS | 10 | <1 | — | <1 |
| DDPS | 0 | <1 | 0 | <1 |
| Comparative sheet | | | | |
| O | 100 | 8 | 0 | 5 |
| G | 85 | 4 | 5 | 4 |
| P | 10 | 3 | 1 | <1 |
| C | 25 | <1 | 2 | <1 |

Explanations

ADPS=$C_2H_5NH—(CH_2)_{12}—PO(OH)_2$

AUDS=$NH_2—(CH_2)_{10}—COOH$

HDLS=$OH—(CH_2)_{11}—COOH$

XDPS=$(OH)_2PO—CH_2—C_6H_4—CH_2—PO(OH)_2$

HDPS=$(OH)_2PO_2—(CH_2)_2—OH$

DDPS=$(OH)_2PO—(CH_2)_{12}—PO(OH)_2$

O=AlMg1 original sheet

G=AlMg1, subjected to alkaline/acid pickling

P=AlMg1, phosphatized

C=AlMg1, chromatized

LPV=Labor-prüf-Vorschriften (in-house laboratory test regulations)

What is claimed is:

1. A process of treating of zinc, magnesium or aluminum or of the alloys of zinc, magnesium or aluminum surfaces for application of lacquers, plastic coatings, paints, sealing compounds or adhesives comprising the steps of:

subjecting a metallic surface comprising at least one metal selected from the group consisting of zinc, zinc alloy, magnesium, magnesium alloy, aluminum and aluminum alloy to at least one of an alkaline pickling bath or an acid pickling bath;

rinsing the pickled metallic surface with water;

applying a film to said metallic surface by treating the metallic surfaces at 10 to 100° C. by at least one of dipping, spraying and rolling with an aqueous solution having a pH from 2 to 13, said solution comprising $10^{-5}$ to 1 mol/l of at least one compound of the formula XYZ, wherein Y is a straight-chain organic group of 2 to 50 carbon atoms;

X is a COOH—, $HSO_3$—, $HSO_4$—, $(OH)_2PO$—, $(OH_2)PO_2$—, (OH)(OR')PO— or $(OH)(OR')PO_2$; and Z is OH—, SH—, $NH_2$—, NHR'—, CN—, $CH{=}CH_2$—, OCN—, $CH_2{=}CR''$—COO—, acrylamide, $(OH)_2PO$—, $(OH)_2PO_2$—, (OH)(OR')PO— or $(OH)(OR')PO_2$;

R' is a $C_1$ to $C_4$ alkyl group;

R" is a hydrogen atom or an alkyl group with 1 to 4 carbon atoms; wherein groups X and Z are each bound to the group Y in their terminal position; wherein said at least one compound of formula XYZ comprises at least one of a phosphoric acid group, a phosphonic acid group, an amino group and a thiol group and bonds to said metallic surface to form said film.

2. A process of treating zinc, magnesium or aluminum or of the alloys of zinc, magnesium or aluminum surfaces for application of lacquers, plastic coatings, paints, sealing compounds or adhesives comprising the steps of:

cleaning a metallic surface comprising at least one metal selected from the group consisting of zinc, zinc alloy, magnesium, magnesium alloy, aluminum and aluminum alloy to remove oxidic layers, said cleaning step comprising subjecting said metallic surface to at least one of an alkaline pickling or an acid pickling bath and rinsing the pickled metallic surface with water;

treating the metallic surfaces at 10 to 100° C. by at least one of dipping, spraying and rolling with an aqueous solution having a pH from 2 to 13, said solution comprising $10^{-5}$ to 1 mol/l of at least one compound of the formula XYZ, wherein Y is a straight-chain organic group of 2 to 50 carbon atoms;

X is COOH—, $HSO_3$—, $HSO_4$—, $(OH)_2PO$—, $(OH_2)PO_2$—, (OH)(OR')PO— or $(OH)(OR')PO_2$; and Z is OH—, SH—, $NH_2$—, NHR'—, CN—, $CH{=}CH_2$—, OCN—, $CH_2{=}CR''$—COO—, acrylamide, $(OH)_2PO$—, $(OH)_2PO_2$—, (OH)(OR')PO— or $(OH)(OR')PO_2$;

R' is a $C_1$ to $C_4$ alkyl group;

R" is a hydrogen atom or an alkyl group with 1 to 4 carbon atoms; wherein groups X and Z are each bound to the group Y in their terminal position; wherein said X group chemically bonds directly to said metallic surface.

3. A process for preparing a film coated metallic surface comprising the steps of:

subjecting a metallic surface comprising at least one metal selected from the group consisting of zinc, zinc alloy, magnesium, magnesium alloy, aluminum and aluminum alloy to at least one of an alkaline pickling or an acid pickling bath under conditions that do not substantially form metal oxides or metal hydroxides on said metallic surface;

subsequently rinsing the pickled metallic surface with water;

treating the metallic surfaces at 10 to 100° C. by at least one of dipping, spraying and rolling with an aqueous solution having a pH from 2 to 13, said solution comprising $10^{-5}$ to 1 mol/l of at least one compound of the formula XYZ, wherein Y is a straight-chain organic group of 2 to 50 carbon atoms;

X is a COOH—, $HSO_3$—, $HSO_4$—, $(OH)_2PO$—, $(OH_2)PO_2$—, (OH)(OR')PO— or $(OH)(OR')PO_2$; and Z is OH—, SH—, $NH_2$—, NHR'—, CN—, $CH{=}CH_2$—, OCN—, $CH_2{=}CR''$—COO—, acrylamide, $(OH)_2PO$—, $(OH)_2PO_2$—, (OH)(OR')PO— or $(OH)(OR')PO_2$;

R' is a $C_1$ to $C_4$ alkyl group;

R" is a hydrogen atom or an alkyl group with 1 to 4 carbon atoms; wherein groups X and Z are each bound to the group Y in their terminal position; wherein at least a portion of said metallic surface is chemically bonded to said compound of formula XYZ.

4. A process for preparing a film coated metallic surface comprising the steps of:

subjecting a metallic surface comprising at least one metal selected from the group consisting of zinc, zinc alloy, magnesium, magnesium alloy, aluminum and aluminum alloy to at least one of an alkaline pickling or an acid pickling bath under conditions that do not substantially form metal oxides or metal hydroxides on said metallic surface;

subsequently rinsing the pickled metallic surface with water;

treating the metallic surfaces at 10 to 100° C. by at least one of dipping, spraying and rolling with an aqueous solution having a pH from 2 to 13, said solution comprising $10^{-5}$ to 1 mol/l of at least one compound of the formula XYZ, wherein Y is a straight-chain organic group of 10 to 12 carbon atoms;

X is a COOH—, $HSO_3$—, $HSO_4$—, $(OH)_2PO$—, $(OH_2)PO_2$—, (OH)(OR)PO— or $(OH)(OR)PO_2$; and Z is OH—, SH—, $NH_2$—, NHR'—, CN—, $CH{=}CH_2$—, OCN—, $CH_2{=}CR''$—COO—, acrylamide, $(OH)_2PO$—, $(OH)_2PO2$—, (OH)(OR')PO— or $(OH)(OR')PO_2$;

R' is a $C_1$ to $C_4$ alkyl group;

R" is a hydrogen atom or an alkyl group with 1 to 4 carbon atoms; wherein groups X and Z are each bound to the group Y in their terminal position; wherein at least a portion of said metallic surface is chemically bonded to said compound of formula XYZ to form the film coated metal surface.

5. A process for preparing a film coated metallic surface comprising the steps of:

subjecting a metallic surface comprising at least one metal selected from the group consisting of zinc, zinc alloy, magnesium, magnesium alloy, aluminum and aluminum alloy to at least one of an alkaline pickling or an acid pickling bath under conditions that do not substantially form metal oxides or metal hydroxides on said metallic surface;

subsequently rinsing the pickled metallic surface with water;

treating the metallic surfaces at 10 to 100° C. by at least one of dipping, spraying and rolling with an aqueous solution having a pH from 2 to 13, said solution comprising $10^{-5}$ to 1 mol/l of at least one compound of the formula XYZ, wherein Y is a straight-chain organic group of 2 to 50 carbon atoms;

X is a COOH—, $HSO_3$—, $HSO_4$—, $(OH)_2PO$—, or $(OH_2)PO_2$—; and

Z is OH—, SH—, $NH_2$—, NHR'—, CN—, $CH{=}CH_2$—, OCN—, $CH_2{=}CR''$—COO—, acrylamide, $(OH)_2PO$—, and $(OH)_2PO_2$—;

R' is a $C_1$ to $C_4$ alkyl group;

R" is a hydrogen atom or an alkyl group with 1 to 4 carbon atoms; wherein groups X and Z are each bound to the group Y in their terminal position; wherein at least a portion of said metallic surface is chemically bonded to the compound of formula XYZ to form the film coated metal surface.

6. A treated metallic substrate comprising:

a metal substrate having a metal surface, said metal being selected from the group consisting of zinc, magnesium and aluminum, said metal surface being film coated with a coating comprising at least one compound of the formula XYZ, wherein Y is a straight-chain organic group of 2 to 50 carbon atoms;

X is a COOH—, $HSO_3$—, $HSO_4$—, $(OH)_2PO$—, $(OH_2)PO_2$—, (OH)(OR')PO— or $(OH)(OR')PO_2$; and Z is OH—, SH—, $NH_2$—, NHR'—, CN—, $CH{=}CH_2$—, OCN—, $CH_2{=}CR''$—COO—, acrylamide, $(OH)_2PO$—, $(OH)_2PO_2$—, (OH)(OR')PO— or $(OH)(OR')PO_2$;

R' is a $C_1$ to $C_4$ alkyl group;

R" is a hydrogen atom or an alkyl group with 1 to 4 carbon atoms;

wherein groups X and Z are each bound to the group Y in their terminal position; wherein said at least one compound of formula XYZ comprises at least one of a phosphoric acid group, a phosphonic acid group, an amino group and a thiol group.

7. The treated metal substrate of claim 6, wherein at least a portion of the XYZ compound is directly chemically bonded to at least a portion of said metal surface.

8. The treated metal substrate of claim 6, wherein the XYZ compound comprises a phosphoric acid group which is oriented toward said metal surface as determined by X-ray photoelectron spectroscopy.

9. The process as claim in claim 1, wherein said aqueous solution further comprises at least one compound selected from the group consisting of 0.1 to 50% of a $C_1$ to $C_4$ alcohol, acetone, dioxan and tetrahydrofuran.

10. The process of claim 1, wherein said XYZ compound is present in a concentration which lies in the range of the critical micellization concentration.

11. The process of claim 1, wherein the aqueous solution further comprises a defoaming agent in an amount of from 0.05 to 5 wt-%.

12. The process of claim 1, wherein the aqueous solution further comprises a solubilizer in an amount of from 0.05 to 5 wt-%.

13. The process of claim 1, wherein said XYZ compound is present as a salt.

14. The process of claim 1, wherein Y selected from the group consisting of an unbranched, straight-chain alkyl group; an unbranched, straight-chain group comprising from 1 to 4 aromatic $C_6H_4$ nuclei connected in the para-position, and a group comprising 1 or 2 unbranched, straight-chain alkyl residues each with 1 to 12 carbon atoms and 1 to 4 aromatic $C_6H_4$ nuclei bonded in the para-position.

15. The process of claim 1, wherein Y is selected from the group consisting of an unbranched, straight-chain alkyl group with 10 to 12 carbon atoms, a p—$CH_2$—$C_6H_4$—$CH_2$—group and a p,p'—$C_6H_4C_6H_4$—group.

16. The process of claim 1, wherein X is selected from the group consisting of a $(OH)_2PO_2$—group and $(OH)(OR')PO_2$—group.

17. The process of claim 1, wherein Z is selected from the group consisting of $(OH)_2PO_2$—, $(OH)(OR')PO_2$—, OH—, SH—, NHR'—, $CH{=}CH_2$—and a $CH_2{=}CR''$—COO—group.

18. The process of claim 1, wherein the XYZ type compound is at least one the member selected from the group consisting of 1-phosphonic acid-12-mercaptododecane;

1-phosphonic acid-12-(N-ethylamino)dodecane;

1-phosphonic acid-12-dodecene;

p-xylylene diphosphonic acid;

1,10-decanediphosphonic acid;

1,12-dodecanediphosphonic acid;

1-phosphoric acid-12-hydroxydodecane;

1-phosphoric acid-12-(N-ethylamino)dodecane;

1-phosphoric acid-12-dodecene;

1-phosphoric acid-12-mercaptododecane;

1,10-decanediphosphoric acid;

1,12-dodecanediphosphoric acid;

p,p'-biphenyldiphosphoric acid, and 1-phosphoric acid-12-acryloyldodecane.

19. The process of claim 1, wherein the dipping time is 5 seconds to 20 minutes, the spraying time is 5 seconds to 15 minutes, and the rolling time is 2 to 120 seconds.

20. The process of claim 1, further comprising drying the treated metallic surface.

21. The process of claim 20, wherein said drying step comprises applying a gas stream comprising at least one of nitrogen and air to said treated metallic surface, wherein the temperature of gas stream is from 15 to 150° C.

* * * * *